United States Patent [19]

Karis

[11] 4,423,995

[45] Jan. 3, 1984

[54] ARRANGEMENT FOR AUTOMATIC CHANGEOVER BETWEEN REAM AND SKID LOADING IN A CONTINUOUS SHEETER

[75] Inventor: Arthur T. Karis, Lenox, Mass.

[73] Assignee: Beloit Corporation, Beloit, Wis.

[21] Appl. No.: 274,638

[22] Filed: Jun. 17, 1981

[51] Int. Cl.[3] ..... B65H 31/22; B65H 31/24

[52] U.S. Cl. ..... 414/43; 271/213; 271/217; 271/299; 414/98; 414/900

[58] Field of Search ..... 414/43, 46, 50, 97, 414/98, 100, 101, 900, 901, 786; 271/213, 217, 218, 219, 279, 299

[56] References Cited

U.S. PATENT DOCUMENTS

| | | | |
|---|---|---|---|
| 2,205,767 | 6/1940 | Lamb | 271/218 X |
| 3,131,819 | 5/1964 | Ducayet, Jr. | 271/213 X |
| 3,233,891 | 2/1966 | Denton et al. | 414/50 X |
| 3,249,242 | 5/1966 | Zachow | 414/98 X |
| 4,269,556 | 5/1981 | Martini | 271/218 X |

FOREIGN PATENT DOCUMENTS

| | | | |
|---|---|---|---|
| 115604 | 10/1969 | Denmark | 414/43 |
| 55-31736 | 3/1980 | Japan | 271/213 |

*Primary Examiner*—Joseph E. Valenza

*Assistant Examiner*—Janice Kirzek

*Attorney, Agent, or Firm*—Hill, Van Santen, Steadman & Simpson

[57] ABSTRACT

A continous sheeting machine is formed with a sheet collection area for the accumulation and stacking of sheets into either ream or skid loads. Separate lift table and discharge means are provided for the respective ream collection or skid loading operations. Changeover between skid loading and ream collection is automatic. A ream collection system is stowed in a retracted position beneath the discharge area of the sheeting machine during skid loading. In the skid loading mode, two large scissor-lift tables shuttle concurrently respectively back and forth between the collection area and a discharge station, such that skid load collection is substantially continous. For ream collection, the skid load tables are removed from the collection area and a ream collection framework is shuttled out from beneath the sheeting machine so that a small, high-speed ream lift table is positioned in the collection area. As the ream collection table is passed into the collection area, a skid guard is pivotally moved between its former upstanding, operational position beneath a kick-off assembly in the sheeting machine discharge area to a lowered, stowed position beneath the ream lift table.

22 Claims, 9 Drawing Figures

FIG. 1
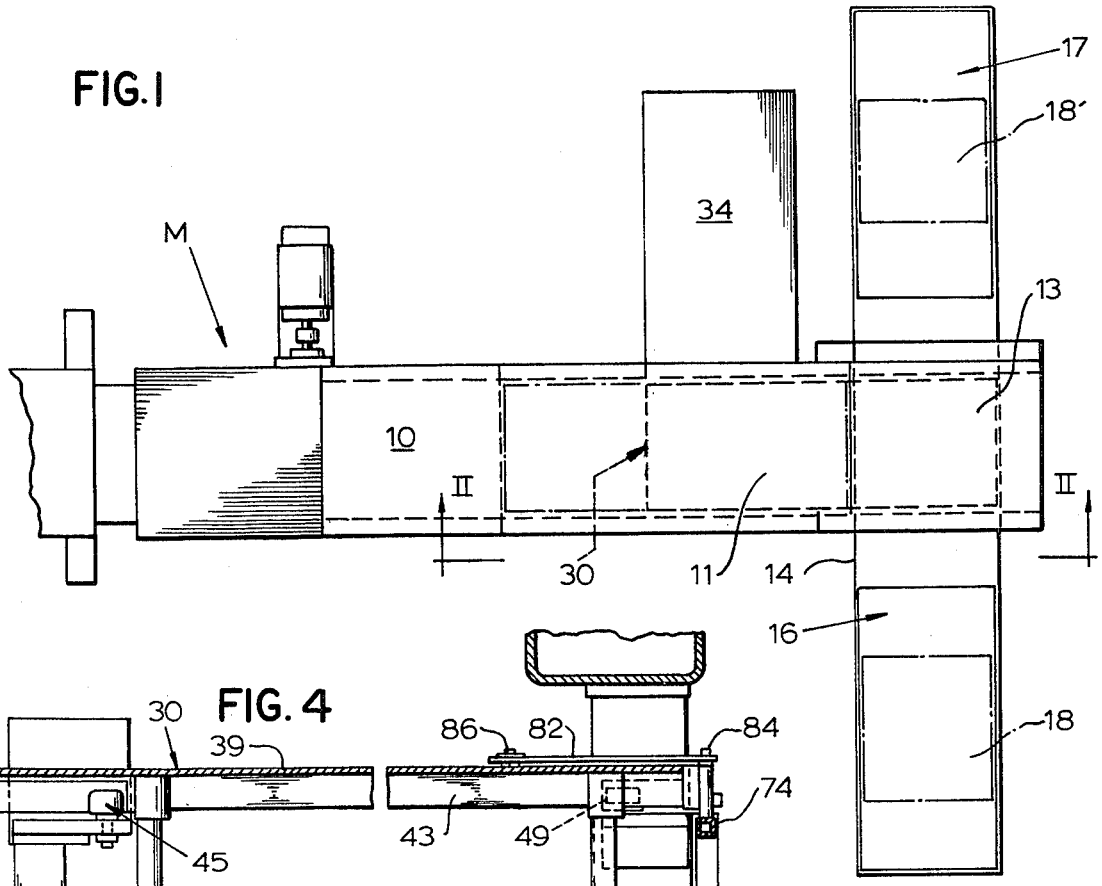
FIG. 4
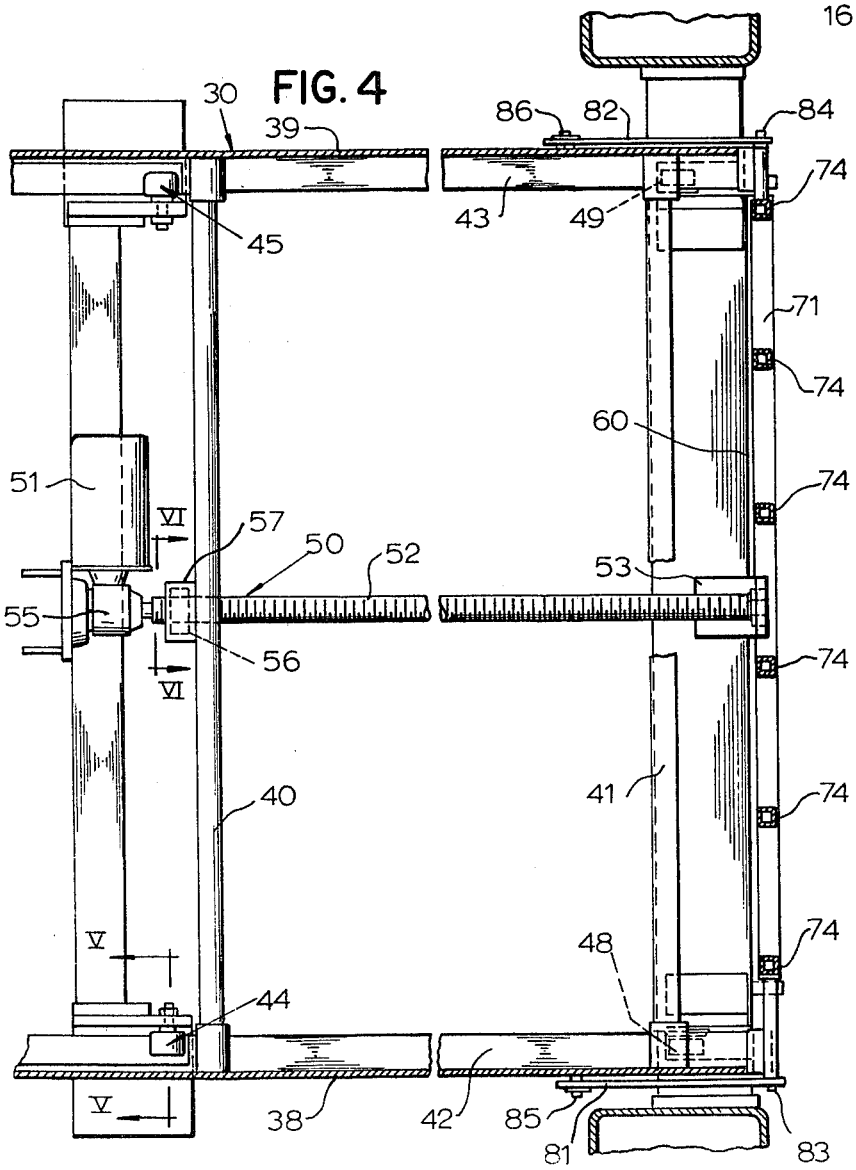
FIG. 5
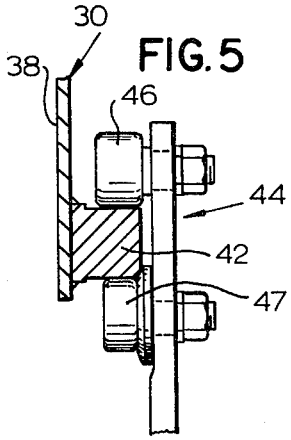
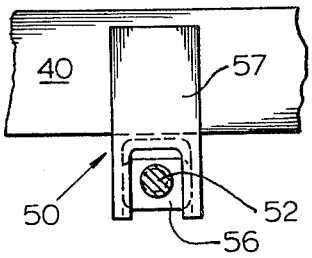
FIG. 6

S
P
M
11
12
13
14
15
16
18
19
20
21
22
23
30
31
32
35
36
37
38
42
44
46
47
48
50
51
54
60
61
62
70
71
72
74
75
76
77
78
79
81
83
85
IV
VIII

ARRANGEMENT FOR AUTOMATIC CHANGEOVER BETWEEN REAM AND SKID LOADING IN A CONTINUOUS SHEETER

BACKGROUND OF THE INVENTION

1. Field of the Invention

The present invention relates to the handling of sheet material and, more particularly, is directed to an automatic arrangement for changing over a continuous discharge sheeter between ream and skid loading.

2. The Prior Art

Sheeting machines are known in which cut sheets, particularly of paper, are advanced seriatim along a delivery conveyor system to a collector device where the sheets collect into piles. Typical collector units enable sheets to collect on a reciprocal platform or table which descends at the growing rate of the stack. The collected stack is then transported to a packaging or cartoning station.

Sheeted paper is typically collected and packaged in two forms. Sheet reams, or carton-size loads, are stacked directly onto transfer conveyor belts. The reams usually reach a maximum height of about 10 inches, weighing about 160 pounds. The conveyor belts are thus able to effectively carry the ream stacks to the packaging station. A very much larger sheet collection form is also conventional. In these cases, sheet stacks typically reach 60 inches high and weigh several thousand pounds. These large stacks must be collected on pallets and are commonly referred to as skid loads. For skid loading, an empty pallet is placed on a reciprocal platform in the collection area. After the pallet has been loaded, it is removed, typically by a fork lift truck, for transport to a packaging station and replaced by an empty pallet to repeat the collection cycle. The terms "ream collecting" and "skid loading" will be used herein to identify and distinguish between these two different forms of sheet collection in a sheeting machine operation.

It is conventional to use a single sheeting machine for the continuous collection of either ream or skid loads on a given production run. A conventional approach to this problem has been to employ two different types of lift tables in the collection area, usually scissors-type lift tables which can be gradually lowered as sheet piles are collected. The different lift tables are necessary because the load requirements for ream piles are very much different from the requirements for piling skid loads of paper. The problem presented by this arrangement is to be able to switch easily from one lift table to the other, while storing the idle table where it will not compromise operator safety, access to the collection area, or the efficient operation of the discharge conveyor systems for the mode in use. This problem is solved by the present invention.

SUMMARY OF THE INVENTION

A continuous sheeting machine is formed with a sheet collection area for the accumulation and stacking of either ream or skid piles. In the skid collection mode, two large hydraulic scissor-lift tables are used. During operation, one skid lift table is positioned in the collection area, while the other lift table is positioned off to one side and readied with an empty pallet elevated to a starting position to receive sheets. When loading of the first pallet has been completed, the two lift tables are laterally shuttled, bringing the loaded pallet out of the collection area for removal by a fork truck and simultaneously bringing the empty pallet into the collection area. An empty pallet is then placed upon the lift table which has been unloaded. When the second pallet has been loaded, the cycle repeats, except that the tables shuttle, this time, in the opposite direction bringing the second loaded pallet out to the opposite side of the collection area for unloading. A transverse pit runs under the collection area to both sides of the sheeting machine containing guide rails and other mechanisms for shuttling and elevating the lift tables.

In the ream collection mode, the large lift tables are shuttled out to respective opposed sides of the pit and lowered to floor level. This effectively eliminates the danger of vacant recesses occurring on either side of the collection area during ream loading. A relatively small, high-speed scissors-lift table is then shuttled laterally out from under the delivery end of the sheeting machine into the collection area. A motor-driven screw arrangement conducts the small lift table into position. As the high-speed lift moves into the collection area, a pivotally mounted guard plate, formerly used during the skid loading mode to guide pallet edges in the collection area, is automatically lowered out of the way by means of a pivoting linkage. The high-speed lift table is cantilevered from support means under the sheeting machine. The leading end of the table is provided with a projection member which rests on a corresponding stop surface in the collection area, so that the free end of the lift table means is firmly supported during ream collection operation. The small lift table assembly is connected with a transfer conveyor means movable with the table, so as to be brought into alignment with a ream cartoning system along one side of the sheeting machine during ream collection operation.

BRIEF DESCRIPTION OF THE DRAWINGS

FIG. 1 is a schematic, broken-away plan view of a sheeting machine collection area constructed in accordance with the present invention.

FIG. 4 is a partly schematic cross-sectional view taken along the lines IV—IV of FIG. 2.

FIG. 5 is a fragmentary cross-sectional view taken along the lines V—V of FIG. 4.

FIG. 6 is a fragmentary cross-sectional view taken along the lines VI—VI of FIG. 4.

DESCRIPTION OF THE PREFERRED EMBODIMENTS

The preferred embodiment relates to the collection of batches or piles of paper sheets. However, other sheet material, such as board or cardboard, may also be handled by the present invention.

Figures 2, 3, 9:
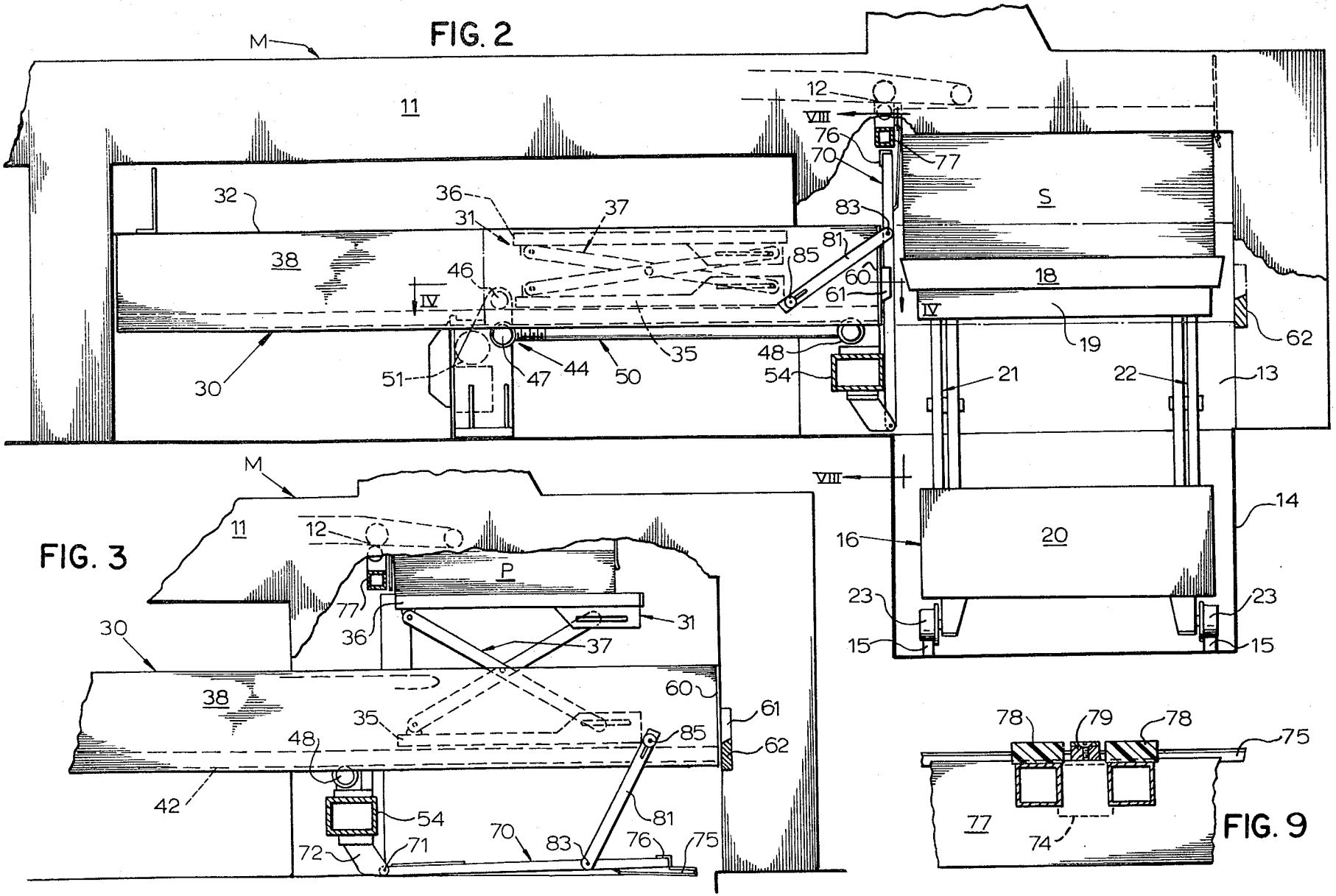
FIG. 2 is a partly schematic cross-sectional view taken along the lines II—II of FIG. 1.
FIG. 3 is a partly schematic, broken-away cross-sectional view of the collection area in the ream collection mode of the present invention.
FIG. 9 is a fragmentary cross-sectional view taken along the lines IX—IX of FIG. 8.

FIGS. 1–2 illustrate a sheeting machine M constructed in accordance with the present invention. Paper sheets are cut from a continuous web in an upstream portion, not shown, of the machine M and passed seriatim along a discharge conveyor means 10, which is preferably in the form of a series of parallel conveyor tapes or belts, to a downstream sheet discharge area 11. In the discharge area, sheets pass through a kick-off conveyor assembly 12 into a collection area 13 for piling. The sheeting machine M is adapted for continuous collection of either ream or carton size piles of paper or skid load stacks for a given production run.

Running transversely through the collection area 13 is a long pit 14 containing a guidetrack means 15 along which shuttle two large, heavy-duty skid lift tables 16 and 17 supported on wheels 23. Each of the skid lift tables 16 and 17 are movable by suitable means (not shown) between positions in and off to one side of the collection area 13. In the skid load collection mode operation of the sheeting machine 10, one skid lift table, such as 16 as shown in FIG. 2, is positioned within the collection area. A skid or pallet 18 is placed upon a vertically movable table top portion 19 of the lift table 16. The table top 19 enters the collection area 13 in an elevated position relative to the lift table base 20, in which position sheets may begin stacking upon the pallet 18 forming a skid load batch S. The table top 19 is gradually lowered as the stack of paper is collected on the pallet. An opposed pair of hydraulic scissor-type lift elements 21 and 22 connected between the table base 20 and the table top 19 serve to raise and lower the table top in the conventional manner.

The remaining skid lift table 17 is constructed in the same manner as the lift table 16 and operates in similar fashion. While the lift table 16 is positioned within the collection area 13, an empty pallet 18' is placed on the table top of the lift table 17 and elevated to a ready position to begin receiving sheet accumulations thereon. After a predetermined skid load stack has accumulated on the skid lift 16 in the collection area 13, the table 16 is conducted back out from the collection area to its corresponding opposed end of the pit 14. As the loaded skid table 16 is removed from the collection area, the other skid table 17 is concurrently conducted into the collection area 13 for sheet accumulation to begin on the empty pallet 18'.

The table top 19 is positioned so as to be approximately even with the floor surface surrounding the pit 14, whereupon a fork lift truck engages the loaded pallet 18 and transfers the skid load stack to a packaging station. Another empty pallet is then placed upon the table top 19 of the lift table 16 and elevated to a starting position to receive sheets. When a skid load has accumulated on the pallet 18' carried by the lift table 17 in the collection area 13, the cycle repeats, except that the lift tables shuttle, this time, in the opposite direction bringing the loaded pallet 18' out to the opposite end of the pit 14 and the lift table 16 into the collection area.

Thus, in the skid load stacking mode, the two skid lift tables 16 and 17 shuttle back and forth on the guidetrack means 15 in the pit 14, so as to enable nearly continuous skid load sheet stacking and discharge. To changeover from skid load collecting to a ream collection mode, the skid lift tables 16 and 17 are shuttled to respective opposed ends of the pit 14 and then lowered so that the table tops are substantially contiguous with the surrounding floor surface. This effectively eliminates the danger of open pit areas occurring on either side of the collection area 13 during ream loading, which may be hazardous to operator safety.

Positioned unobtrusively beneath the discharge conveyor means 10 is a laterally movable ream collection frame 30 carrying a relatively lightweight, small, high-speed ream table 31 adjacent the lead end thereof and a discharge conveyor system 32. The ream collection frame 30 is formed with transversely opposed side surfaces 38 and 39. As illustrated in FIGS. 1 and 3, the ream collector system 30 is laterally movable in order to bring the ream lift table 31 onto the collection area 13.

Positioned off to one side of the sheet discharge area 11 is a stationary, transversely directed feed conveyor device 34 leading to a ream cartoning station (not shown). When the ream collection frame 30 is moved to its operational, forward position with the ream lift table 31 in the collection area 13, the the discharge conveyor 32 becomes aligned with the feed conveyor 34 such that a ream stack received from the ream table onto the discharge conveyor 32 is conducted by the discharge conveyor onto the free end of the feed conveyor 34. In this manner, ream loads collected by the ream table 31 are transferred to the discharge conveyor 32 which conducts the reams onto the feed conveyor 34 for packaging. The conveyors 32 and 34 may comprise a series of parallel, spaced-apart conveyor belts or slats for transferring ream-size loads of paper therealong to the cartoning station. Preferable constructions for the discharge conveyor 32 and feed conveyor 34 are disclosed in the commonly assigned, copending patent application Ser. No. 285,482, filed July 21, 1981 on behalf of joint inventors Arthur Karis and Peter Eberth.

With reference to FIG. 3, the ream table 31 comprises a table base portion 35 secured to the ream collection frame 30 and a vertically movable table top portion 36 on which a ream-size pile P of sheets can be collected in the collection area 13. Scissors-type lift means 37 are suitably connected between the table base and table top to raise and lower the table top in the conventional manner. The table top 36 preferably comprises a series of parallel, spaced-apart platform surfaces which fit in the spaces between the discharge conveyor belts, such that, after a ream pile has accumulated on the table top 36, the ream pile may be transferred to the discharge conveyor belts by lowering the table top 36 beneath the level of the belts. As would be expected, the conveyor belts of the discharge conveyor 32 progressively draw the collected ream pile off the table top 36 and, once the ream pile is fully disposed on the discharge conveyor, further transport means, such as elevated belts, conduct the pile onto the feed conveyor 34. After the ream pile has been transported along the discharge conveyor 32 out of the collection area 13, the table top 36 is again raised to begin collecting a further ream pile and repeat the cycle.

Lateral movement of the ream collection frame 30 into and out of the collection area 13 is performed via means shown in FIGS. 4–6. The front and back portions of the table base 35 are fixedly connected on transversely extending mounting bars 40 and 41 extending between transversely spaced, parallel guide rails 42 and 43 formed beneath the respective side surfaces 38 and 39 of the frame 30. Positioned intermediately along the length of the collection frame 30 is a set of guide roller pairs 44 and 45. The guide roller pairs are similarly constructed, each having an upper roller 46 and lower roller 47 for supporting therebetween a corresponding guide rail of the framework 30, as shown in FIG. 5 with respect to the guide roller pair 44. Each of the upper and lower rollers of the guide roller pair are freely rotatable and serve to support the corresponding track rail for lateral movement therebetween. Positioned beneath the forward end of the collection frame 30 in its retracted position is a pair of further guide rollers 48 and 49 which are freely rotatable for movement of the corresponding guide rails 42 and 43 thereover.

A screw drive arrangement 50 driven by suitable reversible motor means 51 serves to power the ream collector frame 30 between its retracted or stowed position beneath the sheet discharge area 11 and its operational position extending into the collection area 13. The screw drive arrangement 50 comprises a threaded axle member 52 supported for rotation between a bearing housing 53, supported on a stationary frame member 54 of the sheeting machine, at its front end and a drive coupling housing 55 at its rear end. Fitted about the threaded axle 52 is a threadably movable nut member 56 which is loosely contained in a connector bracket 57 fixably joined, such as by welding, to the rear support bar 40 for the ream lift table 31, as shown in FIG. 6.

The ream collection frame 30 is advanced to its operational position, whereby the ream lift table 31 is positioned in the collection area 13, by suitable rotation of the threaded axle 52 such that the nut member 56 is advanced forwardly. During this movement, the lead end of the ream collection frame 30 becomes cantilevered upwardly as it passes out into the collection area due to the disposition of link members 81 and 82 adjacent the forward end of ream collection frame 30 as will be further described below. Extending across the forward free end of the frame 30 is a transverse upstanding wall member 60 formed with a forwardly protruding beveled support member 61. When the ream collector 30 is fully extended, this support surface 61 mates with a corresponding beveled stationary stop surface 62 positioned at the far end of the collection area 13, such that the ream lift table 31 and discharge conveyor 32 are firmly supported during operation.

Figure 7:
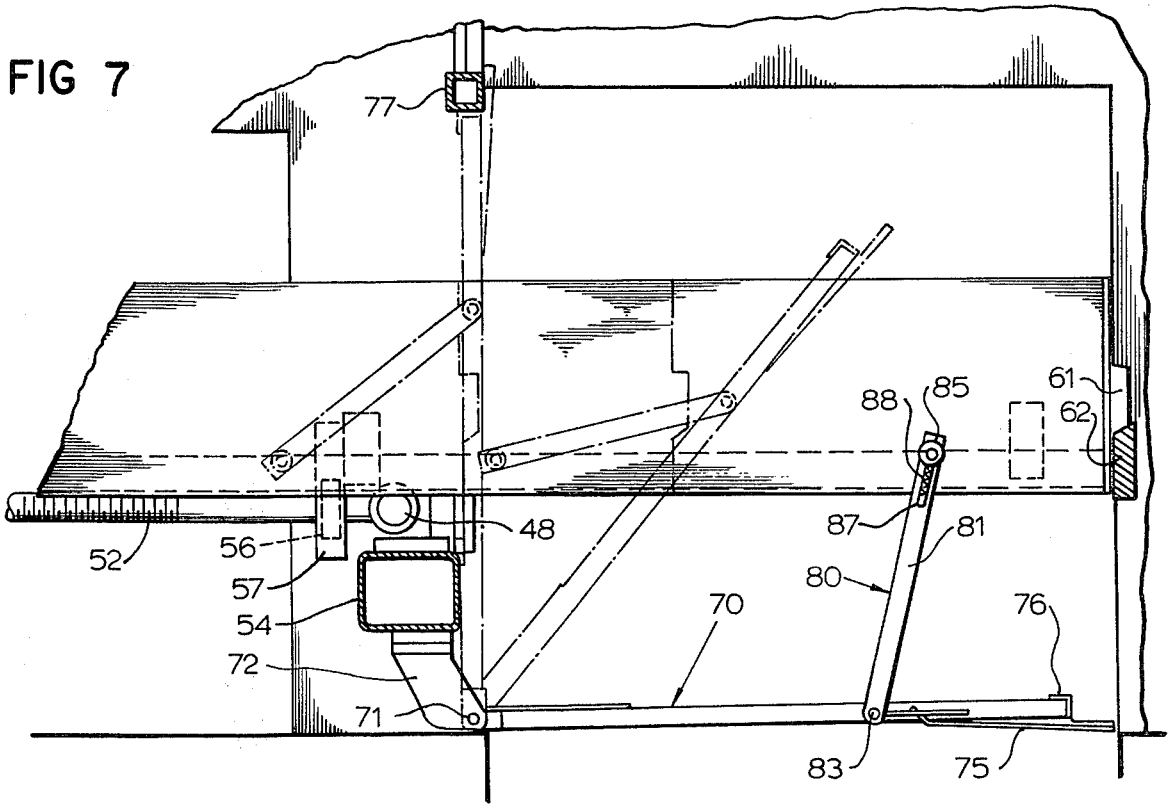
FIG. 7 is a partly schematic, broken-away cross-sectional view illustrating movement of the ream collection table into the collection area in accordance with the present invention.
Figure 8:
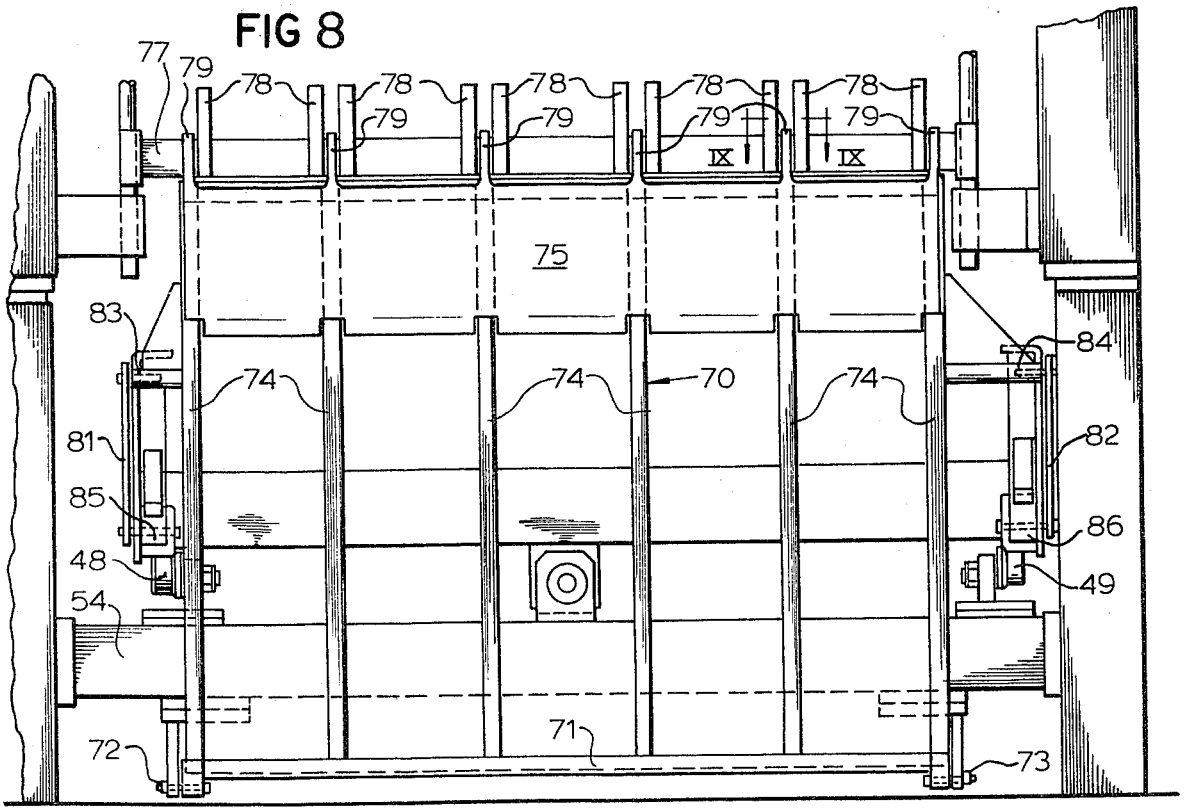
FIG. 8 is a partly schematic cross-sectional view taken along the lines VIII—VIII of FIG. 2.

A skid guard plate means 70, used during the skid loading mode to guide pallet edges in the collection area 13 and protect the lead end of the frame 30 from engagement with pallet edges, extends beneath the kick-off conveyor assembly 12 between the collection area 13 and the stowed ream lift table means 31. With reference to FIGS. 7–9, the guard plate 70 comprises a transversely extending base portion 71, which is pivotally mounted at opposed ends thereof in stationary pin means 72 and 73 fixed to the sheeting machine lower frame portion 54. A series of parallel, spaced-apart upstanding bar members 74 extend upwardly from the horizontal base portion 71. A transverse guard strip 75 is positioned across the front face of the upstanding bars 74 adjacent the upper end of the guard plate. This guard strip 75 is secured at its lower end to the bar members 74 and is formed with an upstanding free end angled slightly outward in the direction of the collection area 13 from the plane of the guard plate 70. The bars 74 are connected together at their upper ends by a top bracket 76 which, in the upstanding position of the guard plate 70, fits beneath a transversely extending frame cross-piece 77 positioned on the sheeting machine M directly beneath the kick-off rollers. Mounted along the stationary cross-piece 77 is a series of short, vertically extending guard cap members 78, as shown in FIGS. 8 and 9. These cap members 78 are preferably formed of resilient material, such as nylon plastic. The free end of the guard strip 75 is correspondingly formed with a series of parallel, spaced-apart tongue elements 79 for resting against the front face of the frame cross-piece 77 serving as stop means when the guard plate 70 is in its vertical, operational position. The stop tongues 79 lie flush with or beneath the front facing surfaces of the resilient cap members 78 when the guard plate 70 is upstanding, such that the cap members 78 and guard strip 75 serve as protective abutment surfaces for skid load pallets adjacent the upper regions of the collection area 13.

In order for the ream collection frame 30 to be brought into the collection area 13 during the ream collection mode, a pivoting linkage mechanism 80 connected between the guard plate 70 and the frame sidewalls 38 and 39 is provided for conducting the guard plate 70 from its upstanding operational position for skid loading operation to a horizontal stowed position beneath the ream collection table 31 when the ream table enters the collection area 13. Movement of the guard plate 70 between its operational position and the stowed position is illustrated in FIG. 7. The pivoting linkage mechanism 80 comprises a pair of link bars 81 and 82 hingedly connected between the guard plate 70 and the opposed frame side surfaces at the forward end of the framework 30. The link members 81 and 82 are pivotally connected by suitable pin means 83 and 84, respectively, at corresponding opposed side surfaces of the guide plate 70. Suitable pin means 85 and 86 also serve to pivotally connect the respective link members 81 and 82 to the opposed side surfaces of the ream collection frame 30; however, these ends of the link members are each provided with a longitudinally extending slot 87 containing a resilient biasing means or spring 88 acting against the corresponding pin connections permitting some slight travel of the pin relative to the link member as the guard plate 70 is directed from its upstanding position to its stowed position.

As shown in FIG. 7, the link members 81 and 82 extend diagonally between the guard plate 70 and the ream collector system 30, when the ream collector system is in its retracted position during skid loading operation. In this position, the skid guard plate 70 is in an upstanding, operational position. As the ream lift table 31 is brought forwardly into the collection area for ream collection operation, the link members 81 and 82 pivot the guard plate 70 about the pin means 72 and 73 such that the guard plate 70 is lowered in front of the lead end wall 60 of the framework 30. When the ream lift table 31 is fully extended in the collection area 13, as shown by the solid line configuration in FIG. 7, the link members 81 and 82 will have brought the guard plate 70 down beneath the ream collection table 31 to a position substantially horizontal across the pit 14.

To change back from ream collecting to skid load operation, rotation of the screw drive arrangement 50 is reversed so that the ream collection table 31 and discharge conveyor system 32 are moved backward beneath the discharge conveyor 10 into the stowed position of the ream collection frame 30. As this movement occurs, the guard plate 70 is brought upward from its lowered position to its operational, upstanding position by the movements shown in dotted line in FIG. 7.

Although various minor modifications may be suggested by those versed in the art, it should be understood that I wish to embody within the scope of the patent warranted hereon all such modifications as reasonably and properly come within the scope of my contribution to the art.

I claim as my invention:

1. A method of automatically changing over a sheeting machine between a skid loading operation for stacking sheets in a large-size pile onto a pallet, and a separate ream collecting operation for stacking sheets in a small-size pile onto a table top, comprising:

discharging sheets in a seriatim flow from a discharge conveyor into a collection area, transversely moving at least one relatively large skid load lift table means carrying said pallet into and out of said collection area during skid loading, laterally moving a relatively small ream lift table means having said table top between a stowed position beneath said discharge conveyor and an operational position in said collection area during ream collecting, and disengaging said skid loading operation from said collection area during ream collecting and disengaging said ream collecting operation from said collection area during skid loading.

2. The method of claim 1, further comprising:

lowering said at least one skid load lift table means to floor level outside said collection area during ream collecting.

3. The method of claim 1, further comprising:

concurrently respectively moving two skid load lift table means transversely into and out of said collection area during skid loading, shuttling said two skid load lift table means between said collection area and respective opposed sides of said collection area, and operating one skid load lift table means in said collection area while the other skid load lift table means is being unloaded and prepared to enter said collection area.

4. The method of claim 3, further comprising:

preparing each skid load lift table to enter said collection area by placing an empty pallet on said corresponding skid load lift table and raising said empty pallet to an elevated starting position to begin accumulating sheets when shuttled into said collection area.

5. The method of claim 1, further comprising:

providing a generally planar guard plate extending vertically between said collection area and said ream lift table means during skid loading and pivotally lowering said guard plate beneath said ream lift table means during ream collecting and raising said guard plate as said ream lift table means is passed back to its stowed position for skid loading.

6. The method of claim 1, further comprising:

shuttling said ream lift table means into its operational position in said collection area with a leading end cantilevered upward and providing said cantilevered leading end with a support member for engaging with a cooperating stationary stop surface when said ream lift table means is operatively positioned in said collection area.

7. Apparatus for automatically changing over a sheeting machine between a skid loading operation for stacking sheets in a large-size pile onto a pallet and a separate ream collecting operation for stacking sheets in a small-size pile onto a table top comprising:

a discharge conveyor means for discharging a seriatim flow of sheets into a collection area, at least one relatively large skid load lift table means carrying said pallet mounted for transverse movement into and out of said collection area during skid loading, a relatively small ream lift table means having said table top mounted for lateral movement between a stowed position beneath said discharge conveyor means and an operational position in said collection area during ream collecting, means for effecting the lateral outfeed of said small-size pile from the ream lift table means, means for completely disengaging and removing said at least one skid load lift table means from said collection area during ream collecting, and means for completely disengaging and putting said ream lift table means in said stowed position during skid loading.

8. The apparatus of claim 7, wherein said sheeting machine is a continuous sheeter.

9. The apparatus of claim 7, further comprising:

means for lowering said skid load lift table means to a position substantially flush with floor level outside said collection area during ream collecting.

10. The apparatus of claim 7, wherein said skid load lift table means comprises a scissors-type lift table.

11. The apparatus of claim 7, further comprising:

an elongated frame portion containing said ream lift table means adjacent a leading end thereof, guide means supporting said frame portion such that said leading end is cantilevered upward as said ream lift table means is shuttled into said collection area, and a support member formed on said leading end for engaging with a cooperating stationary stop surface when said ream lift table means is operatively positioned in said collection area.

12. The apparatus of claim 11, wherein said support member is a forwardly protruding beveled surface and said stop surface is correspondingly beveled for receiving said support member thereon.

13. The apparatus of claim 7, further comprising:

a generally planar guard plate means mounted for pivotal movement between an upstanding operational position between said collection area and said ream lift table means during skid loading and a lowered position beneath said ream lift table means during ream collecting and pivoting linkage means extending between said ream lift table means and said guard plate means.

14. The apparatus of claim 7, wherein two skid load lift table means are provided such that one skid load lift table is operating in said collection area while the other skid load lift table means is being unloaded and prepared to enter said collection area during skid loading.

15. The apparatus of claim 7, further comprising:

a second discharge conveyor means cooperatively connected for movement with said ream lift table means.

16. The apparatus of claim 7, wherein said sheets are paper.

17. The apparatus of claim 7, further comprising:

rotary screw thread drive means driven by a reversible motor for moving said ream lift table means back and forth between its stowed and operational positions.

18. Apparatus for automatically changing over a sheeting machine between a skid loading operation for stacking sheets in a large-size pile onto a pallet, and a separate ream collecting operation for stacking sheets in a small-size pile onto a table top comprising:

a discharge conveyor means for piling a seriatim flow of sheets into a collection area, guidetrack means extending transversely through said collection area, a pair of skid load lift table means carrying pallets mounted for concurrent respective movement along said guidetrack means into and off to a respective opposed side of said collection area during skid loading, a ream collection lift table means having said table top mounted for lateral movement between a stowed position beneath said discharge conveyor means during skid loading and an operational position in said collection area during ream collecting, and means for effecting the lateral outfeed of said small-size pile from the ream lift table means, means for completely disengaging and removing said at least one skid load lift table means from said collection area during ream collecting, and means for completely disengaging and putting said ream lift table means in said stowed position during skid loading.

19. The apparatus of claim 18, further comprising:

a generally planar guard plate means mounted for pivotal movement between an upstanding operational position between said collection area and said ream lift table means during skid loading and a lowered position beneath said ream lift table means during ream collecting.

20. The apparatus of claim 19, further comprising:

pivoting linkage means extending between said ream lift table means and said guard plate means.

21. The apparatus of claim 18, further comprising:

an elongated frame portion containing said ream lift table means adjacent a leading end thereof, and guide means supporting said frame portion such that said leading end is cantilevered upward as said ream lift table means is shuttled into said collection area.

22. The apparatus of claim 21, further comprising:

a support member formed on said leading end for engaging with a cooperating stationary stop surface when said ream lift table means is operatively positioned in said collection area.

* * * * *